US006202562B1

(12) United States Patent
Brunn et al.

(10) Patent No.: US 6,202,562 B1
(45) Date of Patent: Mar. 20, 2001

(54) METHOD OF PREPARING A LOW LETHALITY PROJECTILE FOR FLIGHT

(76) Inventors: Michael Brunn, 308 Littleworth La., Sea Cliff, NY (US) 11579; Jacob Kravel, 2 S. Circle Dr., Great Neck, NY (US) 11021

( * ) Notice: Subject to any disclaimer, the term of this patent is extended or adjusted under 35 U.S.C. 154(b) by 0 days.

(21) Appl. No.: 09/434,453

(22) Filed: Nov. 5, 1999

(51) Int. Cl.[7] ..... F42B 7/02; F42B 12/34
(52) U.S. Cl. ..... 102/502; 102/293
(58) Field of Search ..... 102/293, 400, 102/502

(56) References Cited

U.S. PATENT DOCUMENTS 3,710,720 * 1/1973 Mawhinney ..... 102/42
3,952,662 * 4/1976 Greenlees ..... 102/92.7
4,823,702 * 4/1989 Woolsey ..... 102/502
5,450,795 * 9/1995 Adelman ..... 102/444

* cited by examiner

*Primary Examiner*—Charles T. Jordan
*Assistant Examiner*—Kimberly Smith
(74) *Attorney, Agent, or Firm*—Myron Amer P.C.

(57) ABSTRACT

An anti-personnel projectile launched from a 12 gauge shotgun shell required at impact to have a low lethality consequence, in which the projectile is fitted in the shell in a shape characterized by a blunt end in the direction of flight and maintained in this shape by oppositely directed air resistance and propelling forces to obviate a change of shape during flight that might cause a serious injury.

1 Claim, 1 Drawing Sheet

METHOD OF PREPARING A LOW LETHALITY PROJECTILE FOR FLIGHT

The present invention relates generally to projectiles used primarily for low lethality anti-personnel end use, as for example for crowd control by a municipality police force, and more particularly relates to improvements for assuring that a projectile in use will have the requisite low lethality consequence upon impact, and thus avoiding unintentional severe injury to any individual.

EXAMPLE OF THE PRIOR ART

The need for low lethality projectiles is well known in the art, and additionally can be inferred from the promulgation by the National Institute of Justice of low lethality-qualifying standards exemplified by its standard 0101.03 tests. A known projectile which currently is a low lethality munition of choice consists of a flat bag which is folded in half to fit within a 12 gauge shotgun shell, and after exiting from the muzzle is supposed to unfold into a flat bag shape and impact in this flat bag shape upon a target. As such the kinetic energy is distributed over the area of the bag instead of at a point as in regular ammunition. As a consequence there is less of a possibility of an undesirable penetration while permitting the delivery of a desirable incapacitating impact.

The shape of the above described projectile at impact is not always predictable based solely on its construction as a bag, because the bag can be flat at impact only if it unfolds after exiting from the muzzle. However, on numerous occasions in practice it does not unfold and contacts a target with its folded together side edges and thus, with a shape that can, and often does, inflict serious injury. The inability to predict the projectile shape that will contact the target is believed to occur when several shapes are involved such as, in the case of the above described projectile, i.e., a first shape to accommodate the size dimensions to facilitate being loaded into the 12 gauge shotgun shell, and a second shape to achieve a low lethality consequence upon impact. Logic dictates that the need to change shapes during flight is a happenstance that perhaps most often will occur but which might not occur on occasion due to the shape-change complication.

Broadly, it is an object of the present invention to provide a low lethality anti-personnel projectile overcoming the foregoing and other shortcomings of the prior art.

More particularly, it is an object to impose a low lethality contacting surface of the projectile at impact by the manner in which it is loaded into the 12 gauge shotgun shell, thus requiring no shape change but maintaining in flight the singular shape involved, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

By way of one example of many to serve as background in understanding the present invention, in police management of an unruly crowd, even kept at bay by a barricade, it often escalates to a confrontation between the police and an individual crossing the barricade, which necessitates management of the individual. It is police standard operating procedure to limit force in such a confrontation commensurate to the danger posed. A first and lowest level of force dictated by the circumstances would be to strike the individual, typically at eight to twenty yards, with a low lethality munition, i.e., a munition that does not kill or seriously maim the individual. If, however, continuing with the example, the individual withdraws a concealed weapon, the use of a lethal munition would be dictated.

Figure 4:
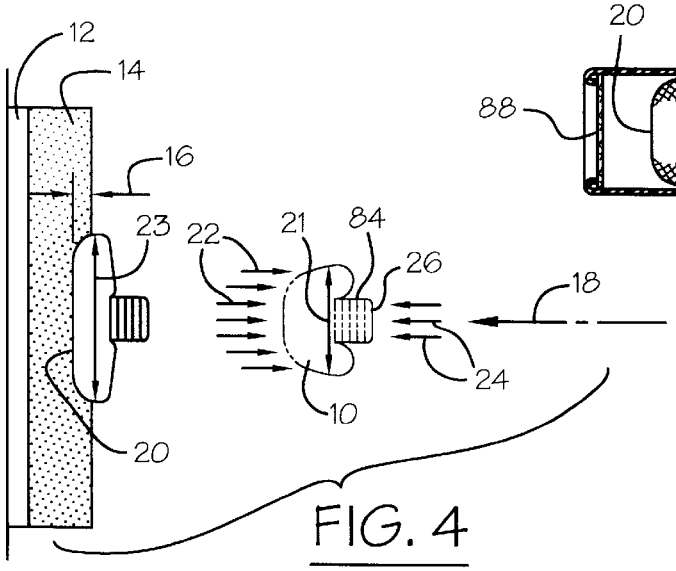
FIG. 4 is an elevational view showing, in full line, the shape of the projectile at impact, and in phantom perspective, the shape of the projectile in flight.

To qualify a munition as being of low lethality, and as best understood from FIG. 4, the projectile 10 is subjected to testing similar to the standard 0101.03 tests used by the National Institute of Justice, which 0101.03 tests to determine the effectiveness of, for example, a "bulletproof" vest measures the depth of deformation of a projectile in a known specific type of viscous clay. Thus, in the testing of projectile 10, there is applies on a target 12, a selected thickness of said known viscosity of clay 14 and it is required that in the typical range of confrontation that a projectile fired from a shotgun (not shown) not penetrate the clay 14 beyond a specified depth 16, which currently is 40 mm.

Underlying the present invention is the recognition that projectile 10, although having physical attributes that might disqualify it as low lethality, can be shaped preparatory to being fired along a path of flight 18 to the target 12 with a blunt or flat end 20 and, most important, that this optimum shaped end 20 is effectively maintained during flight 18 by air resistant forces 22 exerted against the front or blunt end 20 of the projectile 10 and the opposite direction flight-propelling forces 24 exerted against the rear end 26 of the projectile 10. Stated somewhat differently, the opposing forces 22 and 24 maintain an interposed cylindrical shape 28 in the body of the projectile 10, and this shape 28 is characterized by the noted blunt end 20 and, as a result, does not impact upon the target 12 with a lethal consequence. In practice in fact, the opposite directional forces 22 and 24 cause the projectile blunt end 20 to undergo a progressive expanse during flight, as noted at 21, and at impact, as noted at 23.

Figure 1:
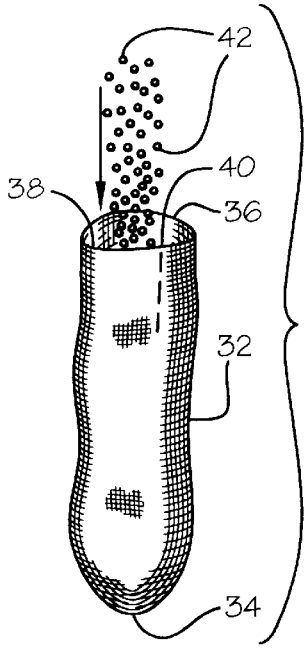
FIG. 1 is a perspective view of a projectile in accordance with the present invention in a work-in-process condition.
Figure 2:
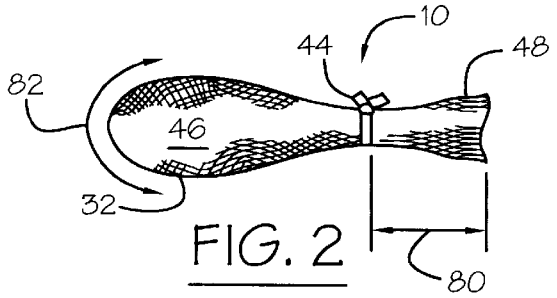
FIG. 2 is an elevational view of the constructed projectile preparatory to being loaded into a 12 gauge shotgun shell.

To achieve low lethality utility, projectile 10 is constructed using a tubular sock-like body of fabric construction material 32 having a closed front end 34 and a rear edge 36 bounding an opening 38 into a body compartment 40. In a work-in-process condition, as illustrated in FIG. 1, a selected amount of lead shot, individually and collectively designated 42, is inserted through the opening 38 to partially fill the compartment 40, particularly in the area of the closed end 34. As best shown in FIG. 2, the construction of the projectile 10 is completed by a tie or the like, as at 44, which delineates the lead shot-filled body 46 from a length portion or tail 48 of the fabric construction material 32.

To launch or propel the constructed projectile of FIG. 2, use is made of an empty 12 gauge shotgun shell, generally designated 50, having a cylindrical wall 52 bounding a compartment 54. Wall 52 has a front edge 56 bounding an opening 58 into the compartment 54 and a rear edge 60 also bounding an opening 62 into the compartment. Prior to loading the projectile 10 through the front opening 58 and into the compartment 54, the rear opening 62 is closed by a sandwiched arrangement of a wad 64 which holds in place propellant 66 in combustible relation to a primer 68, and a brass cap 70.

For completeness' sake, it is noted that although the dimensions of the 12 gauge shotgun shell are well known, that these dimensions as related to the loading of the projectile 10 within the compartment 54 are a compartment length 72 of 2 1/16 inches and a diameter 74 of 3/8 of an inch.

Similarly for completeness' sake, it is noted that in practice best results are achieved with a constructed projectile 10 having a length 76 from its closed end 34 to the applied tie of approximately 1¾ inches and, flattened by slight finger pressure, a maximum width 78 of approximately 1 inch. The tail 48 is cut to length 80 but preferably should not exceed 2½ inches.

The bulk of the FIG. 2 constructed projectile 10 is then manually stuffed through the front opening 58 into the compartment 54 which, not only of course properly positions the projectile 10 for firing, but also reshapes the projectile 10 so it can qualify for low lethality end use. Without this reshaping, the curvature shape 82 of the projectile front end 34 would penetrate the field-testing clay 14 beyond the depth 16, and thus disqualify the projectile 10 as a low lethality munition.

Figure 3:
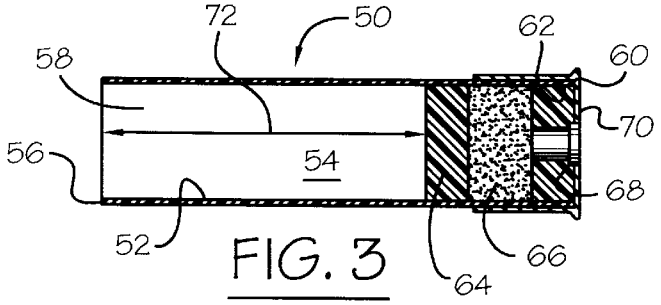
FIG. 3 is a longitudinal cross sectional view of an empty 12 gauge shotgun shell.
Figure 3A:
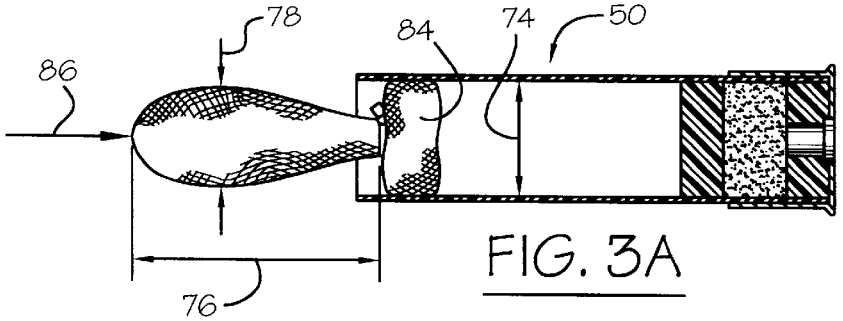
FIGS. 3A and 3B are similarly longitudinal cross sectional views, but showing, in sequence, the loading of the projectile of FIG. 2 into the 12 gauge shotgun shell of FIG. 3.
Figure 3B:
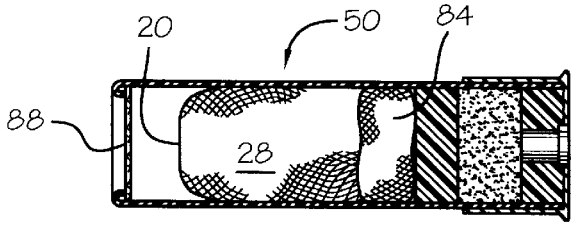

In the loading of the projectile 10 into the cartridge compartment 54, the tail 48 is folded into a resulting bulk, as at 84, and in this folded configuration is urged in movement 86 into the compartment 54, as illustrated in FIG. 3A. Continuing to apply the force 86, the lead-filled projectile front 34 is worked fully into the compartment 54, as illustrated in FIG. 3B, aided by rotational twists of the projectile front end 34 in addition to the longitudinally directed force 86. The cartridge front end opening 58 in then closed in a well known fashion by an appropriate closure 88 appropriately seated and held in place in the end opening 58.

The propellant 66 is then ignited, in a well understood manner, by the primer 68 which, also in a well understood manner, causes the projectile 10 in the shape illustrated in FIG. 3B and is characterized by a blunt-shaped front end 34, reshaped thereinto from a curvature shape 82, to be launched along a path of movement 18 for eventual impact against the target 12 wherein the forces 22 and 24 maintain the blunt shape of the front end 34 during flight movement 18 and, consequently also at impact.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of shaping a projectile so as to have a specified low lethality consequence upon impact against an individual, said shaping method comprising the steps of using an empty 12 gauge shotgun shell having a cylindrical wall bounding a projectile compartment and a front edge and a rear edge at opposite ends of said cylindrical wall respectively bounding a front and a rear opening into said projectile compartment, closing said rear opening of said 12 gauge cartridge shell with projectile-propelling explosive means, using preliminarily an unfilled tubular sock-like projectile body of fabric construction material having a closed front end and a rear edge bounding a rear opening thereinto, filling through said rear opening of said tubular sock-like projectile body a selected amount of lead shot to assume a position therein against said closed end, forming folds in said tubular sock-like projectile body immediately forward of said rear opening thereof, inserting said formed folds of said tubular sock-like projectile body into said projectile compartment front opening, urging in movement said lead shot-filled closed front end of said tubular sock-like projectile body fully into said projectile compartment to an extent causing said formed folds thereof into firm contact against a said closed 12 gauge shotgun shell end and said lead shot-filled closed front end to expand radially into contact with said 12 gauge shotgun shell cylindrical wall so as to assume said cylindrical shape thereof characterized by a blunt front end, and igniting said projectile-propelling means, whereby said tubular sock-like projectile body exits from said 12 gauge shotgun shell projectile compartment in said blunt-ended cylindrical shape against a force of air resistance to flight exerted against a front thereof and pushed by a force urging said shape in flight exerted against a rear thereof such that said blunt-ended cylindrical shape is maintained during flight and at impact to thereby contribute to a low lethality consequence.

* * * * *